US005171422A

United States Patent [19]

Kirker et al.

[11] Patent Number: 5,171,422

[45] Date of Patent: * Dec. 15, 1992

[54] PROCESS FOR PRODUCING A HIGH QUALITY LUBE BASE STOCK IN INCREASED YIELD

[75] Inventors: Garry W. Kirker, Sewell, N.J.; Robert A. Ware, Wyndmoor, Pa.

[73] Assignee: Mobil Oil Corporation, Fairfax, Va.

[ * ] Notice: The portion of the term of this patent subsequent to Apr. 24, 2007 has been disclaimed.

[21] Appl. No.: 640,462

[22] Filed: Jan. 11, 1991

[51] Int. Cl.[5] ..... C10G 47/20; C10G 69/02

[52] U.S. Cl. ..... 208/111; 208/96

[58] Field of Search ..... 208/111, 96

[56] References Cited

U.S. PATENT DOCUMENTS 3,790,470 2/1974 Mead et al. .
3,790,472 2/1974 White .
4,383,913 5/1983 Powell et al. .
4,486,296 12/1984 Oleck et al. .
4,500,417 2/1985 Chen et al. .
4,764,266 8/1988 Chen et al. .
4,820,402 4/1989 Partridge et al. .
4,851,109 7/1989 Chen et al. .
4,855,530 8/1989 LaPierre et al. .
4,919,788 4/1990 Chen et al. .

*Primary Examiner*—Theodore Morris
*Assistant Examiner*—David M. Brunsman
*Attorney, Agent, or Firm*—Alexander J. McKillop
Charles J. Speciale; Malcolm D. Keen

[57] ABSTRACT

A process is provided for producing a high quality lubricating oil base stock in increased yield. The process includes a hydrocracking step employing a catalyst composition comprising a zeolite of the faujasite type, e.g., zeolite USY, possessisng a silica:alumina ratio of at least about 50:1, and a hydrogenation component.

19 Claims, 5 Drawing Sheets

PROCESS FOR PRODUCING A HIGH QUALITY LUBE BASE STOCK IN INCREASED YIELD

BACKGROUND OF THE INVENTION

This invention is directed to a process for producing a high quality lubricating oil base stock which includes a hydrocracking operation in which a high boiling hydrocarbon feedstock, e.g., a vacuum gas oil (VGO), is subjected to hydrocracking conditions in the presence of a high silica content zeolite catalyst of the faujasite type, e.g., ultrastable zeolite Y (USY), possessing at least one hydrogenation component, e.g., nickel, tungsten, molybdenum or combinations thereof.

It has, of course, long been recognized that one of the most valuable products of the refining of crude mineral oils is lubricating oil. It is common practice to recover a lubricating oil base stock by extracting undesirable components such as sulfur compounds, oxygenated compounds and aromatics from a straight run distillate fraction employing a selective solvent. However, with the gradual decline in the availability of paraffinic base crudes and a corresponding increase in the proportion of naphthenic and mixed naphthenic and asphaltic base crudes, it is becoming increasingly difficult to meet the demand for lubricating oil base stock simply by solvent extraction methods.

In response to this situation, hydrocracking has been developed as a process for converting a heavy hydrocarbon feedstock, e.g., one boiling above about 343° C. (about 650° F.), to a hydrocrackate product yielding a 650° F.- distillate fraction and a 650° F.+ fraction which, following conventional solvent refining, provides a lube oil base stock. During hydrocracking, aromatics and naphthenes present in the feedstock undergo a variety of reactions such as dealkylation, isomerization, ring opening and cracking, followed by hydrogenation.

Known hydrocracking catalysts comprise an acid cracking component and a hydrogenation component. The acid component can be an amorphous material such as an acidic clay or amorphous silica-alumina or, alternatively, a zeolite. Large pore zeolites such as zeolites X and Y possessing relatively low silica:alumina ratios, e.g., less than about 40:1, have been conventionally used for this purpose because the principal components of the feedstocks (gas oils, coker bottoms, reduced crudes, recycle oils, FCC bottoms) are higher molecular weight hydrocarbons which will not enter the internal pore structure of the smaller pore zeolites and therefore will not undergo conversion. The hydrogenation component may be a noble metal such as platinum or palladium or a non-noble metal such as nickel, molybdenum or tungsten or a combination of these metals.

SUMMARY OF THE INVENTION

In accordance with the present invention, a process is provided for producing a lubricating oil base stock which comprises:

a) contacting a feedstock to be hydrocracked under hydrocracking conditions with a catalyst comprising a zeolite of the faujasite type possessing a framework silica:alumina ratio of at least about 50:1 and a hydrogenation component to provide a hydrocrackate product; and, b) processing the hydrocrackate product to provide a lubricating oil base stock.

Conducting the hydrocracking step in the presence of a zeolite of the faujasite type possessing a framework silica:alumina ratio of at least about 50:1 results in a significantly greater yield of lube oil base stock compared to that obtained from known hydrocracking operations which employ large pore zeolites of relatively low framework silica:alumina ratios, e.g., ratios which are usually well below 40:1.

DESCRIPTION OF THE PREFERRED EMBODIMENTS

Feedstocks

Figure 1:
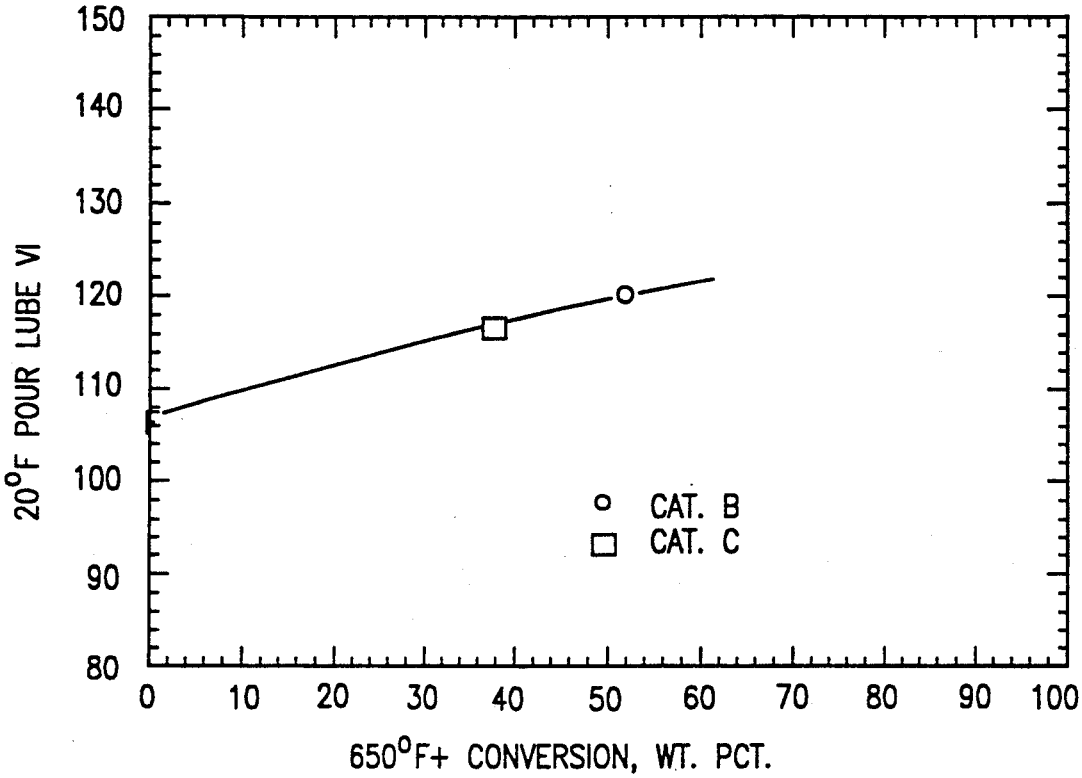
FIGS. 1-9 are graphical representations of process data obtained for lube oil manufacturing operations which are within and outside the scope of the present invention.

The hydrocarbon feed materials suitable for use in the hydrocracking step of the present invention include crude petroleum, reduced crudes, vacuum tower residua, vacuum gas oils, deasphalted residua and other heavy oils. These feedstocks contain a substantial amount of components boiling above about 260° C. (about 500° F.) and normally have an initial boiling point of about 290° C. (about 550° F.) and more usually about 340° C. (about 650° F.). Typical boiling ranges will be from about 340° C. to 565° C. (from about 650° F. to about 1050° F.) or from about 340° C. to about 510° C. (from about 650° F. to about 950° F.) but oils with a narrower boiling range can, of course, also be processed, for example, those with a boiling range of from about 340° C. to about 455° C. (from about 650° F. to about 850° F.). Heavy gas oils are often of this kind as are cycle oils and other non-residual materials. Oils obtained from coal, shale or tar sands can also be treated in this way. It is possible to co-process materials boiling below about 260° C. (about 500° F.) but they will be substantially unconverted. Feedstocks containing lighter ends of this kind will normally have an initial boiling point above about 150° C. (about 300° F.). Feedstock components boiling in the range of from about 290° to about 340° C. (from about 550° to about 650° F.) can be converted to products boiling from about 230° to about 290° C. (from about 450° to about 550° F.) but the heavier ends of the feedstock will be preferentially converted to the more volatile components and therefore the lighter ends may remain unconverted unless the severity of operation is increased sufficiently to convert the entire range of components. In general, the selected feedstock will contain a significant amount of paraffins, e.g., at least about 20 weight percent, and preferably at least about 50 weight percent, paraffins.

The hydrocarbon feedstock can be treated prior to hydrocracking in order to reduce or substantially eliminate its heteroatom content. As necessary or desired, the feedstock can be hydrotreated under mild or moderate hydroprocessing conditions to reduce its sulfur, nitrogen, oxygen and metal content. Generally, a hydrocarbon feedstock used in hydrocracking should have a low metals content, e.g., less than about 200 ppm, in order to avoid obstruction of the catalyst and plugging of the catalyst bed. The mild to moderate hydrotreating conditions employed include pressures of from about 2 to about 21 MPa and $H_2$ consumptions of from about 20 to about 280 $m^3/m^3$. Conventional hydrotreating process conditions and catalysts can be employed, e.g., those described in U.S. Pat. No. 4,283,272, the contents of which are incorporated by reference herein.

Catalyst for the Hydrocracking Step

The catalyst used in the hydrocracking step of the present process comprises a large pore crystalline aluminosilicate of the faujasite family as the acidic component and at least one hydrogenation component which may be at least one noble metal and/or at least one non-noble metal. Suitable noble metals include platinum, palladium and other members of the platinum group such as iridium and rhodium. Suitable non-noble metals include those of Groups VA, VIA, and VIIIA of the Periodic Table. Preferred non-noble metals are chromium, molybdenum, tungsten, cobalt and nickel and combinations of these metals such as nickel-tungsten. Non-noble metal components can be pre-sulfided prior to use by exposure to a sulfur-containing gas such as hydrogen sulfide at elevated temperature to convert the oxide form of the metal to the corresponding sulfide form.

The metal can be incorporated into the zeolite by any suitable method such as impregnation or exchange. The metal can be incorporated in the form of a cationic, anionic or neutral complex; $Pt(NH_3)_4^{2+}$ and cationic complexes of this type will be found convenient for exchanging metals onto the zeolite. Anionic complexes such as heptamolybdate or metatungstate ions are also useful for impregnating metals into the catalysts.

The amount of hydrogenation component can range from about 0.01 to about 30 percent by weight and is normally from about 0.1 to about 15 percent by weight. The precise amount will, of course, vary with the nature of the component, less of the highly active noble metals, particularly platinum, being required than of the less active base metals.

The acidic component of the hydrocracking catalyst is a large pore crystalline aluminosilicate of the faujasite type possessing a silica:alumina ratio of at least about 50:1 and a hydrocarbon sorption capacity for n-hexane of at least about 6 percent. The hydrocarbon sorption capacity of a zeolite is determined by measuring its sorption at 25° C. and at 40 mm Hg (5333 Pa) hydrocarbon pressure in an inert carrier such as helium. The sorption test is conveniently carried out in a TGA with helium as a carrier gas flowing over the zeolite at 25° C. The hydrocarbon of interest, e.g., n-hexane, is introduced into the gas stream adjusted to 40 mm Hg hydrocarbon pressure and the hydrocarbon uptake, measured as an increase in zeolite weight, is recorded. The sorption capacity may then be calculated as a percentage in accordance with the relationship:

$$\text{Hydrocarbon Sorption Capacity (\%)} = \frac{\text{Wt. of Hydrocarbon Sorbed}}{\text{Wt. of Zeolite}} \times 100$$

Included among the faujasite type zeolites which can be used in the hydrocracking operation of this invention are faujasite, zeolite X, zeolite Y, ultrastable zeolite Y (USY), and the like. Control of the silica:alumina ratio of the zeolite in its as-synthesized form can be achieved through an appropriate selection of the relative proportions of the starting materials, especially the silica and alumina precursors, a relatively smaller quantity of the alumina precursor resulting in a higher silica:alumina ratio in the product zeolite, up to the limits of the synthetic procedure. If higher ratios are desired and alternative synthesis directly affording such ratios are unavailable, other techniques such as those described below can be used to provide the desired highly siliceous zeolites.

It should be understood that the silica:alumina ratio referred to in this specification is the structural or framework ratio, that is, the ratio of the $SiO_4$ to the $AlO_4$ tetrahedra which together constitute the structure of the zeolite. This ratio can vary according to the analytical procedure used for its determination. For example, a gross chemical analysis may include aluminum which is present in the form of cations associated with the acidic sites on the zeolite thereby giving a low silica:alumina ratio. Similarly, if the ratio is determined by thermogravimetric analysis (TGA) of ammonia desorption, a low ammonia titration may be obtained if cationic aluminum prevents exchange of the ammonium ions onto the acidic sites. These disparities are particularly troublesome when certain treatments such as the dealuminization methods described below which result in the presence of ionic aluminum free of the zeolite structure are employed. Due care should therefore be taken to ensure that the framework silica:alumina ratio is correctly determined.

A number of different methods are known for increasing the structural silica:alumina ratios of various zeolites. Many of these methods rely upon the removal of aluminum from the structural framework of the zeolite employing suitable chemical agents. Specific methods for preparing dealuminized zeolites are described in the following to which reference may be made for specific details: "Catalysis by Zeolites" (International Symposium on Zeolites, Lyon, Sep. 9–11, 1980), Elsevier Scientific Publishing Co., Amsterdam, 1980 (dealuminization of zeolite Y with silicon tetrachloride); U.S. Pat. No. 3,442,795 and U.K. Pat. No. 1,058,188 (hydrolysis and removal of aluminum by chelation); U.K. Pat. No. 1,061,847 (acid extraction of aluminum); U.S. Pat. No 3,493,519 (aluminum removal by steaming and chelation); U.S. Pat. No. 3,591,488 (aluminum removal by steaming); U.S. Pat. No. 4,273,753 (dealuminization by silicon halide and oxyhalides); U.S. Pat. No. 3,691,099 (aluminum extraction with acid); U.S. Pat. No. 4,093,560 (dealuminization by treatment with salts); U.S. Pat. No. 3,937,791 (aluminum removal with Cr(III) solutions); U.S. Pat. No. 3,506,400 (steaming followed by chelation); U.S. Pat. No. 3,640,681 (extraction of aluminum with acetylacetonate followed by dehydroxylation); U.S. Pat. No. 3,836,561 (removal of aluminum with acid); German Offenleg. No. 2,510,740 (treatment of zeolite with chlorine or chlorine-containing gases at high temperatures), Dutch Pat. No. 7,604,264 (acid extraction), Japanese Pat. No. 53/101,003 (treatment with EDTA or other materials to remove aluminum) and *J. Catalysis*, 54, 295 (1978) (hydrothermal treatment followed by acid extraction).

Because of their convenience and practicality, the preferred dealuminization methods for preparing the present highly siliceous large pore zeolites are those which rely upon acid extraction of the aluminum from the zeolite. Briefly, this method comprises contacting the zeolite with an acid, preferably a mineral acid such as hydrochloric acid. Dealuminization proceeds readily at ambient and mildly elevated temperatures and occurs with minimal losses in crystallinity to form highly siliceous forms of the zeolite with silica:alumina ratios of at least about 50:1, with ratios of about 200:1 or even higher being readily attainable in most cases.

The zeolite is conveniently used in the hydrogen form for the dealuminization process although other cationic forms can also be employed, for example, the sodium form. If these other forms are used, sufficient acid should be employed to allow for the replacement by protons of the original cations in the zeolite. The zeolite should be used in a convenient particle size for mixing with the acid to form a slurry of the two components. The amount of zeolite in the slurry should generally be from about 5 to about 60 percent of weight.

The acid can be an inorganic or an organic acid. Typical inorganic acids which can be employed include mineral acids such as hydrochloric, sulfuric, nitric and phosphoric acids, peroxydisulfonic acid, dithionic acid, sulfamic acid, peroxymonosulfuric acid, amidosulfonic acid, nitrosulfonic acid, chlorosulfuric acid, pyrosulfuric acid and nitrous acid. Representative organic acids which can be used include formic acid, trichloroacetic acid and trifluoroacetic acid.

The concentration of added acid should be such as not to lower the pH of the reaction mixture to a level which could adversely affect the crystallinity of the zeolite. The acidity which the zeolite can tolerate will depend, at least in part, upon the silica:alumina ratio of the starting material. Higher silica:alumina ratios can be obtained employing starting zeolites of relatively low silica:alumina ratio, e.g., those below about 40:1 and especially below about 30:1.

The dealuminization reaction proceeds readily at ambient temperatures but mildly elevated temperatures can be employed, e.g., up to about 100° C. The duration of the extraction will affect the silica:alumina ratio of the product since extraction, being diffusion controlled, is time dependent. However, because the zeolite becomes progressively more resistant to loss of crystallinity as the silica:alumina ratio increases, i.e., it becomes more stable as aluminum is removed, higher temperatures and more concentrated acids can be used towards the end of the dealumination treatment than at the beginning without the attendant risk of an undue loss of crystallinity.

After the extraction treatment, the product is water-washed free of impurities, preferably with distilled water, until the effluent wash water has a pH within the approximate range of from about 5 to about 8.

Catalytic materials for particular uses can be prepared by replacing the cations as required with other metallic or ammoniacal ions. If calcination is carried out prior to ion exchange, some or all of the resulting hydrogen ions can be replaced by metal ions in the ion exchange process.

The silica:alumina ratio of the zeolite hydrocracking catalyst herein will be at least about 50:1, preferably at least about 100:1 and still more preferably at least about 150:1. Ratios of 200:1 or higher, e.g., 250:1, 300:1, 400:1 and 500:1, can be obtained by use of known dealumination procedures. If desired, the zeolite can be steamed prior to acid dealumination so as to increase its silica:alumina ratio and render the zeolite more stable to the acid. Steaming can also serve to increase the ease with which framework aluminum is removed and to promote the retention of crystallinity during the dealumination procedure.

Highly siliceous forms of zeolite Y can be prepared by steaming, by acid extraction of structural aluminum or both. However, since zeolite Y in its normal, as-synthesized condition is unstable to acid, the zeolite must ordinarily be converted to an acid-stable form prior to dealumination by acid treatment. Methods for doing this are known and one of the most common forms of acid-resistant zeolite Y is known as "Ultrastable Y" (USY). Zeolite USY is described, inter alia. in U.S. Pat. Nos. 3,293,192 and 3,402,996. In general, "ultrastable" refers to a Y-type zeolite which is highly resistant to degradation of crystallinity by high temperature and steam treatment and is characterized by a $R_2O$ content (wherein R is Na, K or any other alkali metal ion) of less than 4 weight percent and preferably less than 1 weight percent, a unit cell size of less than about 24.5 Angstroms and a silica:alumina mole ratio in the range of 3.5:1 to 7:1 or higher. The ultrastable form of Y-type zeolite is obtained primarily by a substantial reduction of the alkali metal ions and the unit cell size.

The ultrastable form of the Y-type zeolite can be prepared by successively base exchanging a Y-type zeolite with an aqueous solution of an ammonium salt such as ammonium nitrate until the alkali metal content of the zeolite is reduced to less than about 4 weight percent. The base exchanged zeolite is then calcined at a temperature of from about 540° C. to about 800° C. for up to several hours, cooled and successively base exchanged with an aqueous solution of an ammonium salt until the alkali metal content is reduced to less than about 1 weight percent, followed by washing and calcination again at a temperature of from about 540° C. to about 800° C. to produce an ultrastable zeolite Y. The sequence of ion exchange and heat treatment results in the substantial reduction of the alkali metal content of the original zeolite and results in a unit cell shrinkage which is believed to lead to the ultra high stability of the resulting Y-type zeolite.

The ultrastable zeolite Y can then be extracted with acid as generally described above to produce a highly siliceous form of the zeolite which is then suitable for use in the hydrocracking operation of the present lube oil base stock production process. Other methods for increasing the silica:alumina ratio of zeolite Y by acid extraction are described in U.S. Pat. Nos. 4,218,307, 3,591,488 and 3,691,099 to which reference may be made for the details thereof.

It may be desirable to incorporate the zeolite in another material which is resistant to the temperature and other conditions employed in the process. Such matrix, or binder, materials include synthetic or natural substances as well as inorganic materials such as clay, silica and/or metal oxides. The latter can be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or they can be initially subjected to calcination, acid treatment or chemical modification.

The zeolite can be composited with a porous matrix material, e.g., an inorganic oxide binder such as alumina, silica, titania, zirconia, silica-alumina, silica-magnesia, silica-zirconia, silica-thoria, silica-berylia, silica-alumina-thoria, silica-alumina-zirconia, silica-alumina-magnesia and silica-magnesia zirconia, and the like. The matrix can be in the form of a cogel with the zeolite. The relative proportions of zeolite component and inorganic oxide binder material can vary widely with the zeolite content ranging from about 1 to about 99, and more usually from about 5 to about 80, percent by weight of the composite. The binder material can itself possess catalytic properties generally of an acidic nature.

Hydrocracking Conditions

In the hydrocracking step of the present process, the feedstock is contacted with the aforedescribed catalyst in the presence of hydrogen under hydrocracking conditions of elevated temperature and pressure. Conditions of temperature, pressure, space velocity, hydrogen:feedstock ratio and hydrogen partial pressure which are similar to those used in conventional hydrocracking operations can conveniently be employed herein. Process temperatures of from about 230° C. to about 500° C. (from about 450° F. to about 930° F.) can conveniently be used although temperatures above about 425° C. (about 800° F.) will normally not be employed as the thermodynamics of the hydrocracking reactions become unfavorable at temperatures above this point. Generally, temperatures of from about 300° C. to about 425° C. (from about 570° F. to about 800° F.) will be employed. Total pressure is usually in the range of from about 500 to about 20,000 kPa (from about 38 to about 2,886 psig) with pressures above about 7,000 kPa (about 986 psig) normally being preferred. The process is operated in the presence of hydrogen with hydrogen partial pressures normally being from about 600 to about 16,000 kPa (from about 72 to about 2,305 psig). The hydrogen:feedstock ratio (hydrogen circulation rate) will normally be from about 10 to about 3,500 $n.l.l^{-1}$ (from about 56 to about 19,660 SCF/bbl.). The space velocity of the feedstock will normally be from about 0.1 to about 20 LHSV and preferably from about 0.1 to about 1.0 LHSV. Employing the foregoing hydrocracking conditions, conversion of feedstock to hydrocrackate product can be made to come within the range of from about 20 to about 80 weight percent. The hydrocracking conditions are advantageously selected so as to provide a conversion of from about 30 to about 60, and preferably from about 40 to about 50, weight percent.

The conversion can be conducted by contacting the feedstock with a fixed stationary bed of catalyst, a fixed fluidized bed or with a transport bed. A simple configuration is a trickle-bed operation in which the feed is allowed to trickle through a stationary fixed bed. With such a configuration, it is desirable to initiate the hydrocracking reaction with fresh catalyst at a moderate temperature which is, of course, raised as the catalyst ages in order to maintain catalytic activity.

Processing the Hydrocrackate Product to Provide a Lubricating Oil Base Stock The hydrocrackate product herein is further processed by one or more downstream operations, themselves known in the art, to provide a high quality lubricating oil base stock. For example, the hydrocrackate can be fractionated by distillation to provide a 650° F.+ fraction which is then subjected to solvent refining (solvent extraction). The details of solvent refining are well known to those skilled in the art and, accordingly, need not be described in detail herein. It is sufficient to note that solvent refining generally consists of contacting, usually in a counter-current fashion, the material to be fractionated with a solvent which has a greater affinity for one of the fractions than the other. Many solvents are available for separating aromatic fractions from paraffinic fractions and the use of all such solvents is considered to be within the scope of the present invention. Although it is believed that solvents such as phenol, furfural, ethylene glycol, liquid sulfur dioxide, dimethyl sulfoxide, dimethylformamide, n-methyl pyrrolidone and n-vinyl pyrrolidone are all acceptable for use as solvents, furfural, phenol and n-methyl pyrrolidone are generally preferred. Further processing of the raffinate stream preferably comprises dewaxing the raffinate employing any of the known dewaxing operations such as, for example, "pressing and sweating", centrifugation, solvent dewaxing and catalytic dewaxing using shape selective zeolites.

Alternatively, a heavy fraction of the hydrocrackate product, e.g., a 650° F.+ fraction, can be directly subjected to solvent dewaxing or catalytic dewaxing in accordance with known procedures to provide a high quality lubricating oil base stock.

The following examples are illustrative of the process of the invention for producing a high quality lubricating oil base stock.

EXAMPLE 1

This example illustrates the preparation of three hydrocracking catalysts, Catalysts A, B and C, with Catalysts A and B possessing silica:alumina ratios below the minimum required by the process of this invention and Catalyst C possessing a silica:alumina ratio making it suitable for use herein.

Catalyst A

A 50/50 wt/wt mixture of commercial conventional silica-to-alumina ratio USY zeolite and alumina was mulled and extruded to prepare a formed mass. The extruded mass was dried at 250° F. and thereafter calcined for 3 hrs in 5 v/v/min flowing air at 1000° F. The calcined product was cooled, exchanged twice with 1N $NH_4NO_3$ for 1 hr at room temperature, rinsed with deionized water, air dried at 250° F. and then calcined at 1000° F. for 3 hrs in 5 v/v/min. in air. The exchange/calcination procedure was repeated twice. The extrudate was impregnated to incipient wetness with a solution of ammonium metatungstate and thereafter (1) dried for 4 hrs at room temperature, (2) dried at 250° F. overnight and (3) calcined for 2 hrs at 1000° F. in flowing air. The calcined product was then impregnated to incipient wetness with a nickel nitrate solution and steps (1), (2) and (3) were repeated. The properties of the final catalyst, identified as Catalyst A, are set forth in Table 1 below.

Catalyst B

A 50/50 wt/wt mixture of commercial conventional silica-to-alumina ratio USY zeolite and alumina was mulled and extruded to prepare a formed mass. The extruded mass was dried at 250° F. and thereafter calcined for 3 hrs in 5 v/v/min flowing air at 1000° F. The calcined product was cooled, exchanged twice with 1N $NH_4NO_3$ for 1 hr at room temperature, rinsed with deionized water, air dried at 250° F. and then calcined at 1000° F. for 3 hrs in 5 v/v/min in air. The exchange/calcination procedure was repeated twice followed by a hydrothermal treatment at 950° F. for 10 hrs in 1 atm steam. The steamed extrudate was impregnated to incipient wetness with a solution of ammonium metatungstate and thereafter (1) dried for 4 hrs at room temperature, (2) dried at 250° F. overnight and (3) calcined for 2 hrs at 1000° F. in flowing air. The calcined product was then impregnated to incipient wetness with a nickel nitrate solution and steps (1), (2) and (3) were repeated. The properties of the final catalyst, identified as Catalyst B, are set forth in Table 1 below.

Catalyst C

A 50/50 wt/wt mixture of commercial high silica:alumina ratio USY zeolite and alumina was mulled and extruded to prepare a formed mass. The extruded mass was dried at 250° F. and calcined for 3 hrs in 5 v/v/min flowing air at 1000° F. The calcined product was then steamed at 1025° F. for 24 hrs in 1 atm steam. The steamed extrudate was impregnated to incipient wetness with a solution of ammonium metatungstate and thereafter (1) dried at 250° F. overnight and (2) calcined for 2 hrs at 1000° F. in flowing air. The calcined product was then impregnated to incipient wetness with a nickel nitrate solution and steps (1) and (2) were repeated. The properties of the final catalyst, identified as Catalyst C, are set forth in Table 1 below. The properties of a fourth catalyst, HDN-30, which was employed for hydrotreating purposes, are also set forth in Table 1.

TABLE 1

| Properties | Hydrocracking Catalyst Properties | | | |
|---|---|---|---|---|
| | Catalyst A | Catalyst B | Catalyst C | HDN-30 |
| Catalyst alpha* | 146 | 50 | 5 | — |
| Particle density, g/cc | 1.05 | 1.05 | 1.15 | 1.43 |
| Surface area, $m^2/g$ | 272 | 240 | 335 | 138 |
| Pore volume, cc/g | 0.643 | 0.645 | 0.563 | 0.389 |
| Pore diameter, Å | 94 | 107 | 67 | 113 |
| Nickel, wt % | 4.2 | 3.7 | 3.9 | 3.9 |
| Tungsten, wt % | 15.0 | 13.5 | 12.6 | — |
| Molybdenum, wt % | — | — | — | 13.7 |
| Sodium, ppm | 370 | 370 | 155 | |
| Silica: Alumina Ratio (determined by $^{29}$Si-NMR) | | | | |
| Parent zeolite | 7.6 | 7.6 | 220 | |
| Finished catalyst | 11.4 | 33 | 220 | |

*The catalysts contained 50 wt % zeolite in alumina binder.

EXAMPLE 2

This example illustrates the production of lubricating oil base stocks from a vacuum gas oil (VGO) feedstock the properties of which are set forth in Table 2 below:

TABLE 2

| Properties | VGO Feedstock |
|---|---|
| Hydrogen, Wt % | 12.34 |
| Nitrogen, ppm | 800 |
| Basic Nitrogen, ppm | 230 |
| Sulfur, Wt % | 2.34 |
| API Gravity | 21.8 |
| Pour Point, °F. | 95 |
| KV @ 40° C.,cSt. | 74.340 |
| KV @ 100° C.,cst. | 7.122 |
| Paraffins, Wt % | 24.09 |
| Mono Naphthenes | 7.02 |
| Polynaphthalenes | 15.11 |
| Aromatics | 53.77 |

Hydrocracking of the VGO feedstock was carried out in a packed-bed, trickle-flow reactor to compare the performance of hydrocracking catalysts A, B and C described in Example 1, supra. The hydrocracking operations were conducted in cascade mode with HDN-30 catalyst (Table 1supra) loaded upstream in a ½ vol/vol ratio. In each case, the hydrocracking catalyst was pre-sulfided with 2% $H_2S$ in hydrogen using a standard laboratory procedure. The reactor was operated at 1500 psig $H_2$ at 0.5 LHSV and 4000 scf/bbl $H_2$ circulation. In these experiments, boiling range conversion was varied by changing reactor temperature. The TLP products from the reaction were distilled to yield a 650° F.+ "unconverted" bottoms fraction and 650° F.− products. The 650° F.+ bottoms fraction was solvent refined using conventional procedures to yield a lubricating oil base stock. The solvent refining procedure consisted of a batch furfural treatment at 142° F. and 1000 volume percent dosage to yield a raffinate which was then solvent dewaxed with a 60/40 (vol/vol) mixture of methyl ethyl ketone (MEK) and toluene at a 3/1 solvent/raffinate (vol/vol) dose to yield the lubricating oil base stock.

Figure 2:
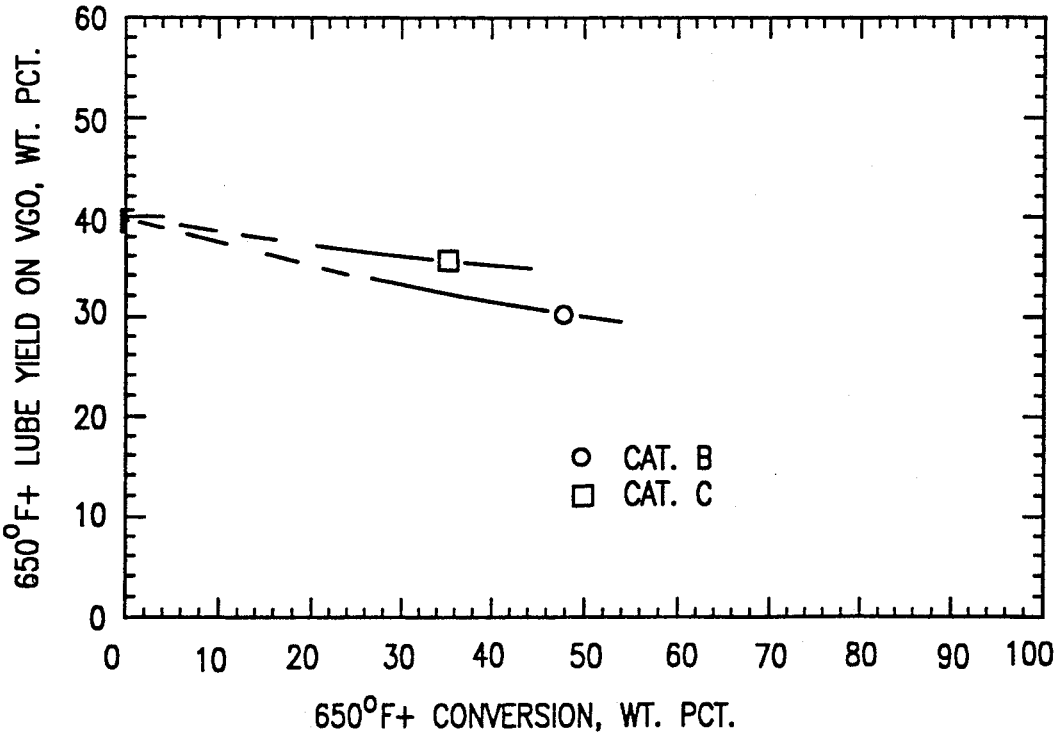
Figure 3:
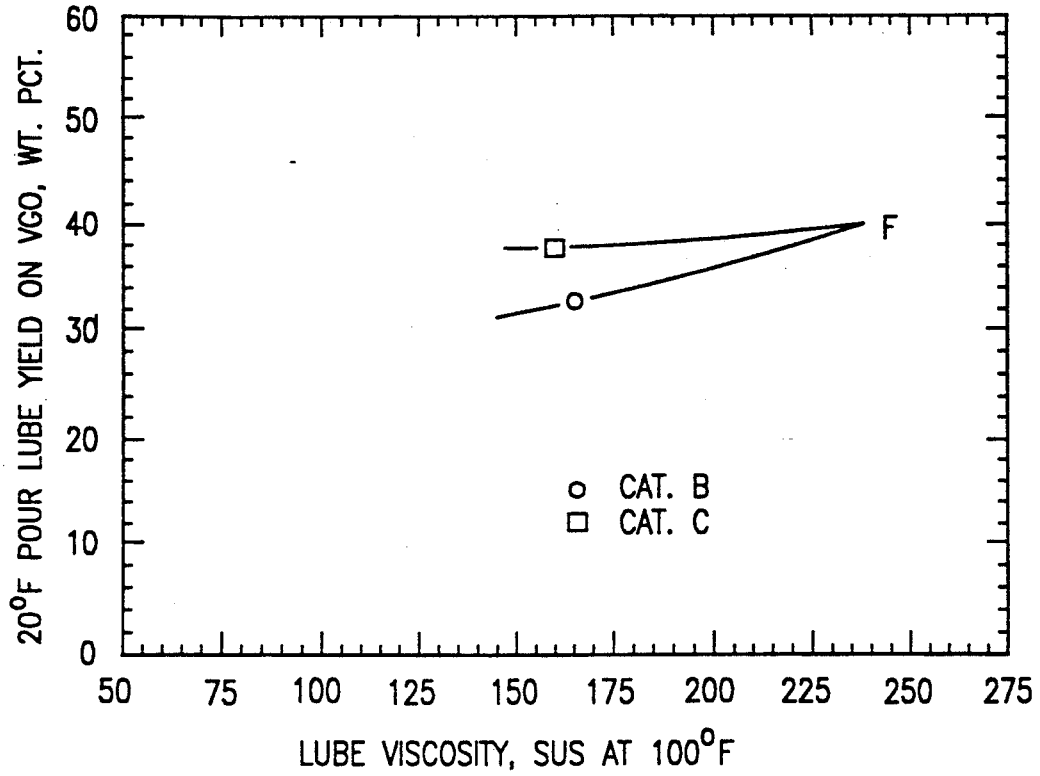
Figure 4:
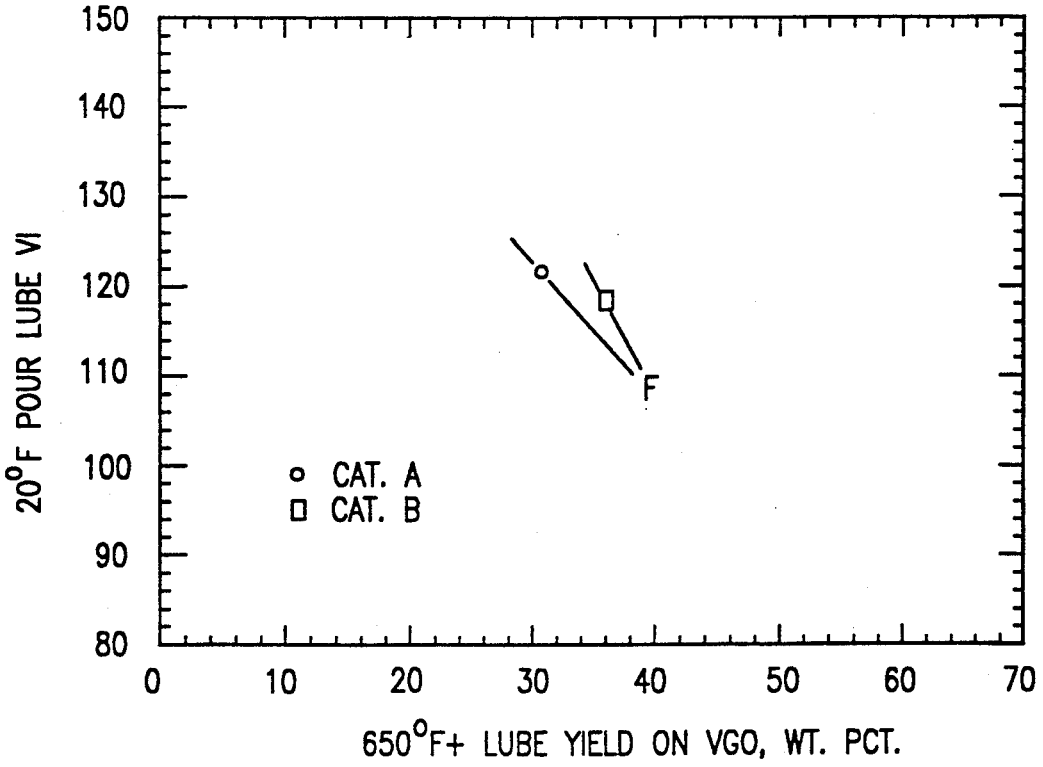

Hydrocracking the VGO feedstock in separate runs over Catalysts B and C resulted in an improvement in lube VI (FIG. 1) relative to the solvent-refined raw VGO (FIG. 4 in which F represents the lube obtained from solvent processing the feedstock). However, Catalyst C provided an unexpected increase in lubricating oil base stock yield relative to Catalyst B as a function of hydrocracker boiling range conversion (FIG. 2) and lube viscosity (FIG. 3). This lube yield benefit was provided with no loss in lube VI (FIG. 1).

EXAMPLE 3

This example illustrates the production of lubricating oil base stocks from a VGO feedstock whose properties are set forth in Table 3 below:

TABLE 3

| Properties | VGO Feedstock Properties |
|---|---|
| Hydrogen, Wt % | 14.01 |
| Nitrogen, ppm | 450 |
| Basic Nitrogen, ppm | 177 |
| Sulfur, Wt % | 0.11 |
| API Gravity | 32.0 |
| Pour Point, °F. | 115 |
| KV @ 40°, cSt. | — |
| KV @ 100°, cSt. | 4.178 |
| Paraffins, Wt % | 56.48 |
| Mono Naphthenes | 6.36 |
| Poly Naphthenes | 17.74 |
| Aromatics | 19.42 |

Hydrocracking of the VGO feedstock was carried out substantially as described in Example 2, supra, employing Catalysts A, B and C. However, the 650° F+ bottoms fractions of the resulting hydrocrackate products were subjected only to the MEK/toluene dewaxing step of Example 2 to provide the finished lubricating oil base stock products.

Figure 5:
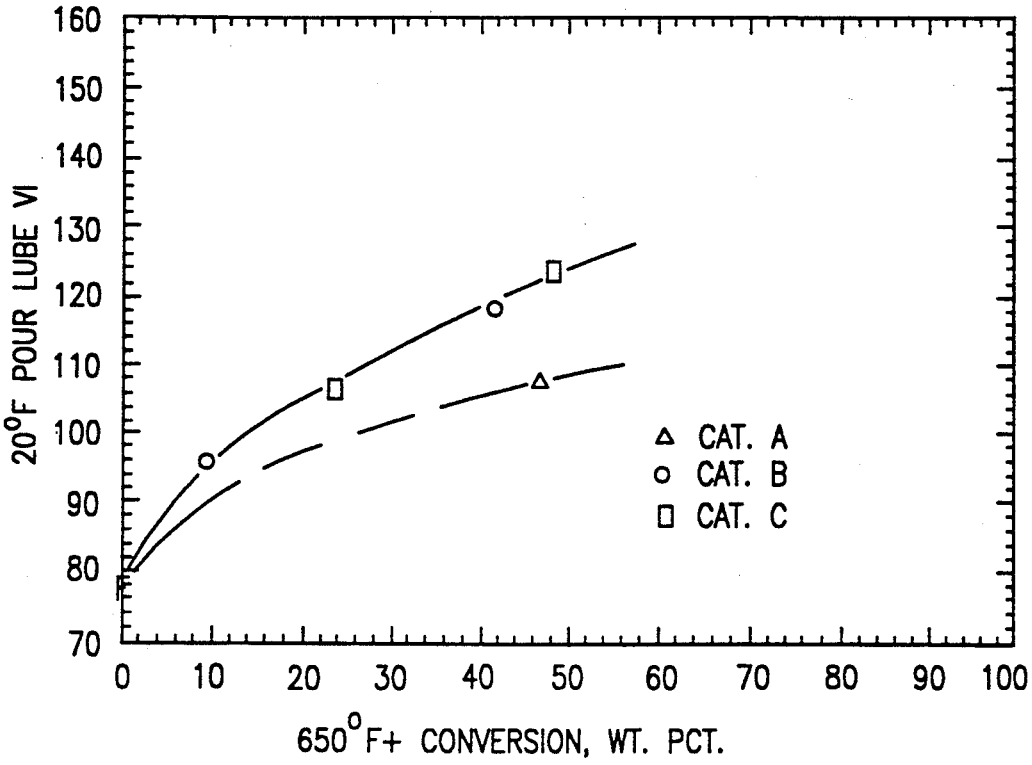
Figure 6:
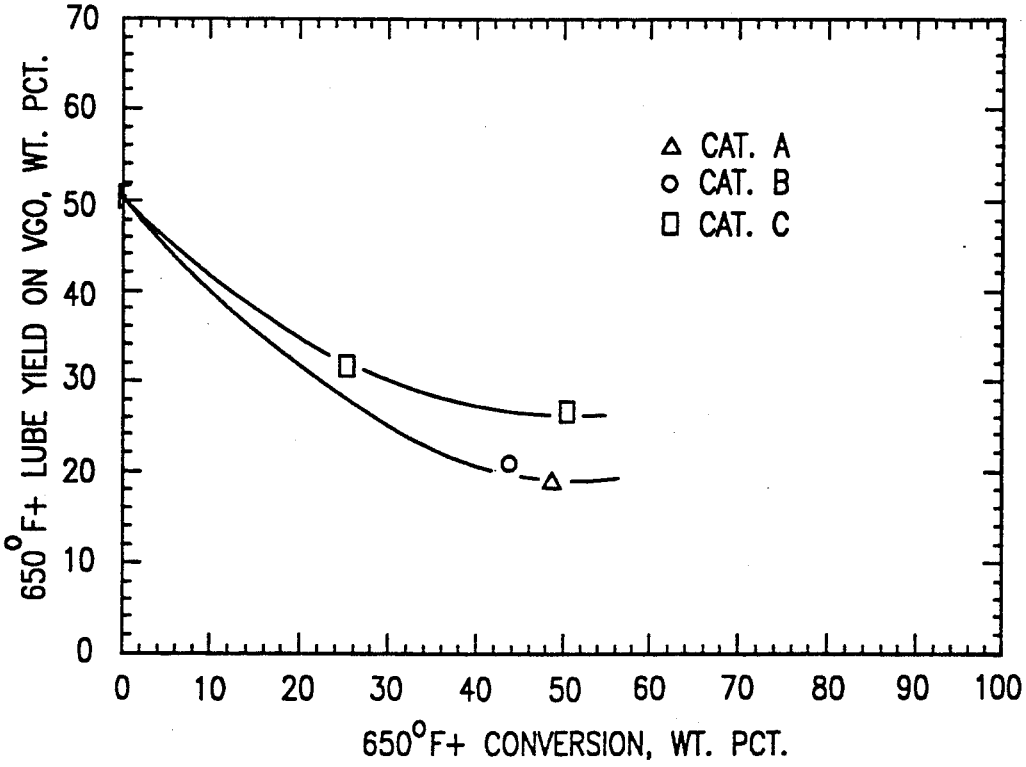
Figure 7:
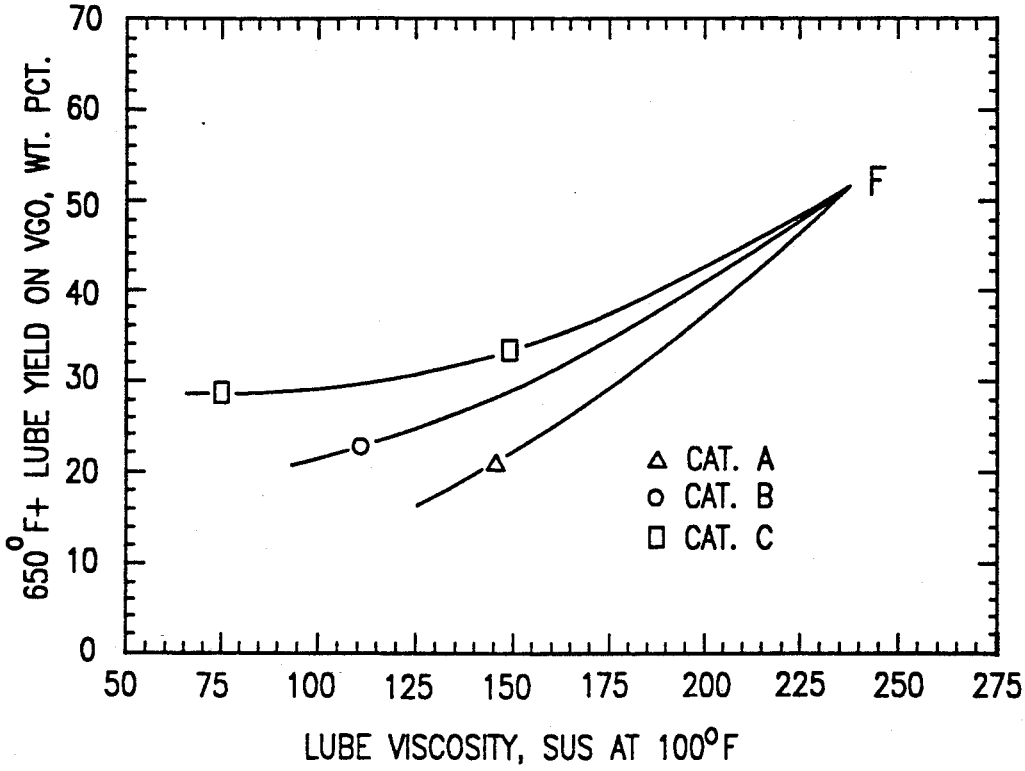
Figure 9:
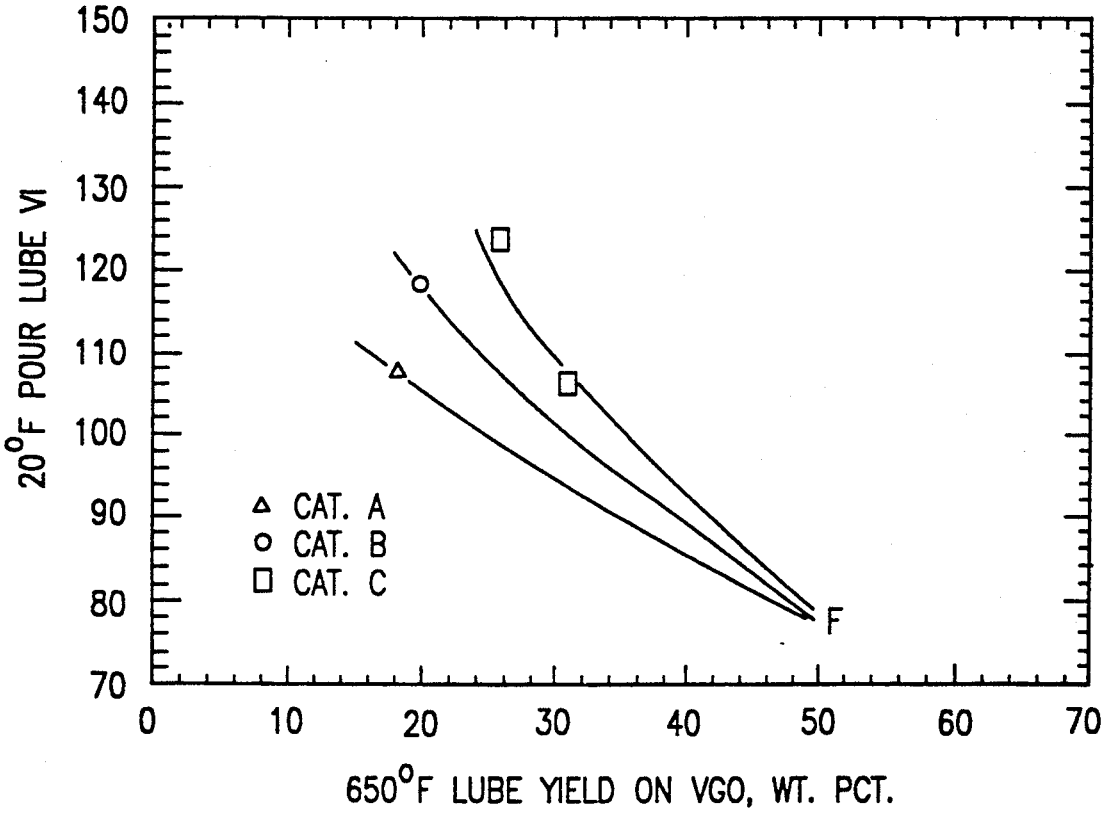

Significant VI improvement was obtained by catalytic hydroprocessing over the USY catalysts (FIG. 5) compared with the lube obtained solely by solvent processing the feedstock (lube F of FIG. 9). The high silica:alumina ratio USY catalyst (Catalyst C) provided an unexpected increase in dewaxed lube yield relative to the other USY hydrocracking catalysts (Catalysts A and B) as a function of boiling range conversion (FIG. 6). Lube yield as a function of viscosity (FIG. 7) showed a significant advantage for Catalyst C relative to Catalysts A and B. Furthermore, this lube yield advantage was obtained without loss in lube quality as measured by lube VI (FIG. 5).

Figure 8:
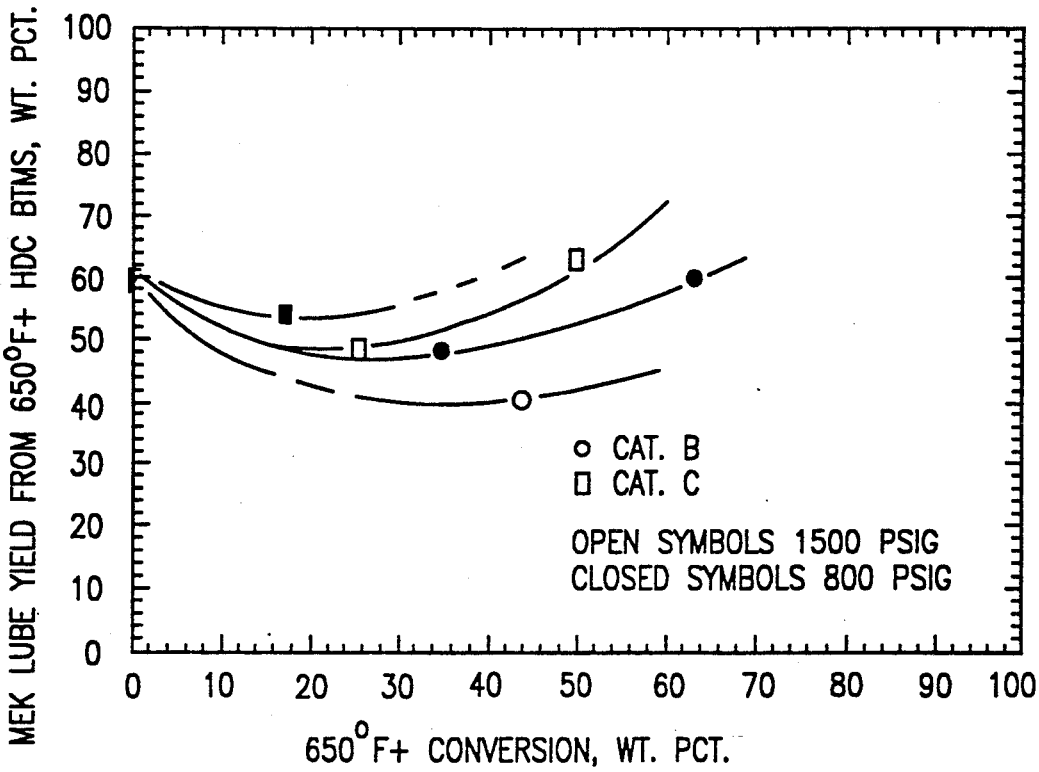

In addition, the yield of 20° F. pour point lubricating oil base stock following solvent dewaxing was significantly higher when the hydrocracking step was carried out with Catalyst C than in the case where hydrocracking was carried out with Catalyst B (FIG. 8).

What is claimed is:

1. A process for producing a lubricating oil base stock which comprises:

a) contacting a feedstock to be hydrocracked under hydrocracking conditions including a temperature of from about 230° C. to about 500° C., a pressure of from about 500 to about 20,000 kPa, a hydrogen partial pressure of from about 600 to about 16,000 kPa, a hydrogen circulation rate of from about 10 to about 3500 n.l.l.$^{-1}$ and a LHSV of from about 0.1 to about 20, with a catalyst comprising a zeolite of the faujasite structure possessing a framework slilca:alumina ratio of at least about 50:1 and a hydrogenation component to provide a hydrocracked product; and, b) processing the hydrocracked product to provide a lubricating oil base stock.

2. The process of claim 1 wherein the zeolite is selected from the group consisting of faujasite, zeolite X, zeolite Y, and zeolite USY.

3. The process of claim 1 wherein the framework silica:alumina ratio of the zeolite is at least about 100:1.

4. The process of claim 1 wherein the framework silica:alumina ratio of the zeolite is at least about 150:1.

5. The process of claim 1 wherein the hydrogenation component is at least one metal selected from the group consisting of Groups VA, VIA and VIIIA of the Periodic Table.

6. The process of claim 1 wherein the hydrogenation component is at least one metal selected from the group consisting of nickel, cobalt, molybdenum, tungsten, platinum and palladium.

7. The process of claim 1 wherein the zeolite is combined with a binder material.

8. The process of claim 1 wherein the zeolite is combined with a binder material selected from the group consisting of alumina, silica, zirconia, titania and combinations thereof.

9. The process of claim 1 wherein the zeolite is zeolite USY and the hydrogenation component is at least one metal selected from the group consisting of Groups VA, VIA and VIIIA of the Periodic Table.

10. The process of claim 1 wherein the feedstock contains at least about 20 weight percent paraffins.

11. The process of claim 1 wherein the feedstock contains at least about 50 weight percent paraffins.

12. The process of claim 1 providing a conversion of from about 20 to about 80 weight percent.

13. The process of claim 1 providing a conversion of from about 30 to about 60 weight percent.

14. The process of claim 1 providing a conversion of from about 40 to about 50 weight percent.

15. The process of claim 1 wherein a 650 ° F.+ fraction of the hydrocrackate product is subjected to solvent refining, dewaxing or a combination of solvent refining and dewaxing.

16. The process of claim 15 wherein the dewaxing is carried out under solvent dewaxing or catalytic dewaxing conditions.

17. The process of claim 1, wherein the feedstock contains at least about 30% aromatics.

18. The process of claim 1, wherein the feedstock contains at least about 40% aromatics.

19. A process for producing a lubricating oil base stock which comprises:

a) contacting a feedstock to be hydrocracked under hydrocracking conditions with a catalyst comprising a zeolite of the faujasite structure possessing a framework silica:alumina ratio of at least about 50:1 and a hydrogenation component to provide a hydrocracked product; and, b) processing the hydrocrackate product to provide a lubricating oil base stock, wherein the yield of said base stock is significantly higher than that resulting from substantially the same process wherein the hydrocracking step is carried out in the presence zeolite of the faujasite structure zeolite possessing a silica:alumina ratio of less than about 50:1.

* * * * *